US005402632A

United States Patent [19]

Nobre et al.

[11] Patent Number: 5,402,632

[45] Date of Patent: Apr. 4, 1995

[54] METHOD OF SURGE DETECTION

[75] Inventors: Anthony Nobre, Brossard; Daniel Gratton, Kirkland, both of Canada

[73] Assignee: Pratt & Whitney Canada, Inc., Quebec, Canada

[21] Appl. No.: 172,343

[22] Filed: Feb. 22, 1994

[51] Int. Cl.[6] ..... F02C 9/16

[52] U.S. Cl. ..... 60/39.02; 60/39.161; 60/39.29

[58] Field of Search ..... 60/39.02, 39.091, 39.161, 60/39.27, 39.29; 415/26, 27, 28, 30, 36, 39, 46

[56] References Cited

U.S. PATENT DOCUMENTS

| | | | |
|---|---|---|---|
| 3,006,144 | 10/1961 | Arnett et al. | 60/39.28 |
| 3,876,326 | 4/1975 | Weitz | 60/39.29 |
| 4,117,688 | 10/1978 | Elsaesser et al. | 60/39.29 |
| 4,430,855 | 2/1984 | Deneux et al. | 60/39.29 |
| 4,449,360 | 5/1984 | Evans | 60/39.281 |
| 4,756,152 | 7/1988 | Krukoski | 60/39.29 |
| 5,051,918 | 9/1991 | Parsons | 60/39.091 |

*Primary Examiner*—Louis J. Casaregola
*Attorney, Agent, or Firm*—Edward L. Kochey, Jr.

[57] ABSTRACT

The double derivative of the gas generator shaft (16) is sensed and compared to upper and lower limits to determine breaches of these limits within a first predetermined time, in which case a first potential surge condition is declared. The derivative of torque, or the double derivative of shaft speed, of the power shaft (22) is sensed and compared to upper and lower limits to determine breaches of these limits within a second predetermined time, in which case a second potential surge condition is declared. If both a first and second potential surge condition is declared within a third predetermined time, an actual surge condition is declared.

8 Claims, 3 Drawing Sheets

METHOD OF SURGE DETECTION

TECHNICAL FILED

The invention relates to the detection of compressor surges or stalls in a gas turbine engine, and in particular to the detection of such surges on a dual spool turbine.

BACKGROUND OF THE INVENTION

In a gas turbine engine the blades of the compressor can stall much in the same way as an airplane wing. When the relationship between the incoming air velocity and the speed of the blade creates too high an effective angle of attack the blade stalls and no longer pumps air. When a sufficient number of blades stall to affect the operation of the compressor, the phenomenon is known as surge.

During a surge of a gas turbine engine the combustor pressure immediately and sharply decreases. This occurs because the air is not being pumped into the combustor while the air in the combustor continues to exit through the turbine. Because of the decreased pressure in the combustor, a decrease in the energy delivered to the turbine immediately follows.

Surges can often occur during a ramped increase in power where the increase is too rapid for the particular conditions experienced by the engine. When a surge occurs under such operation the corrective action is to immediately decrease fuel flow until the surging stops, and then return to a power ramp which may be less steep than the original ramp.

It is important to detect these surges because of the high stresses and loads associated with them.

A prior method of detecting the surge includes sensing a decrease in the compressor discharge pressure. This is an acceptable method, but the parameter is not always available.

An alternate method of detecting compressor surge is desirable.

SUMMARY OF THE INVENTION

The sensing of the compressor surge in a dual spool gas turbine engine includes first measuring the speed of the gas generator shaft and determining the double derivative of that shaft speed. This is effectively the rate of change of acceleration of the shaft. This double derivative is compared to a first negative limit and a second positive limit with breaches of these limits being sensed. When both the low and high limits are exceeded within a predetermined time a first potential surge condition is declared.

In a somewhat similar manner the torque of the power turbine shaft is sensed and the derivative determined. This is compared to another low and high limit with breaches of these limits being determined. If the breaches occur of both limits within a second predetermined time a second potential surge condition is declared.

If both the first potential surge condition and the second potential surge condition occur within a third predetermined time then an actual surge condition is determined.

Where the power shaft has a low moment of inertia load secured thereto, the speed of the shaft would be more responsive than the torque. Therefore the double derivative of the power turbine shaft would also be used in a manner similar to that of the gas generator shaft.

The jerk effect of the surge on the power turbine shaft directly affects the rate of acceleration of the shaft and also the torque passed through the shaft. The derivative of the acceleration (double derivative of speed) or the derivative of torque is therefore used depending on the moment of inertia of the load.

DESCRIPTION OF THE PREFERRED EMBODIMENT

Figure 1:
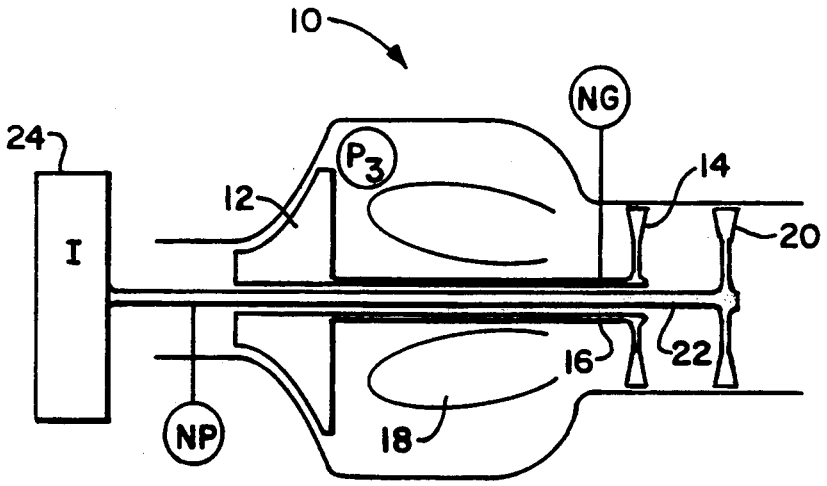
FIG. 1 is a schematic of a dual spool gas turbine engine.

In FIG. 1 there is shown a dual shaft gas turbine engine 10 with a compressor 12 and a turbine 14 on the gas generator shaft 16. The compressed air from the compressor is passed to combustor 18 where fuel is burned with the gases passing through turbine 14 and also turbine 20.

Turbine 20 is mounted on power shaft 22 with a high moment of inertia load 24 secured thereto in the form of helicopter blades.

The air flowing from the combustor 18 is delivering energy to, or pushing, both turbines 14 and 20. A surge in compressor 12 results in a rapid pressure decrease in combustor 18 and accordingly a sudden decrease in the push against the two turbines. Once the pressure in the combustor has decreased the compressor 12 is able to pump against this reduced back pressure thereby resulting in a rapid pressure increase in the combustor 18. This results in a rapid power increase delivered to turbines 14 and 20.

Figure 2:
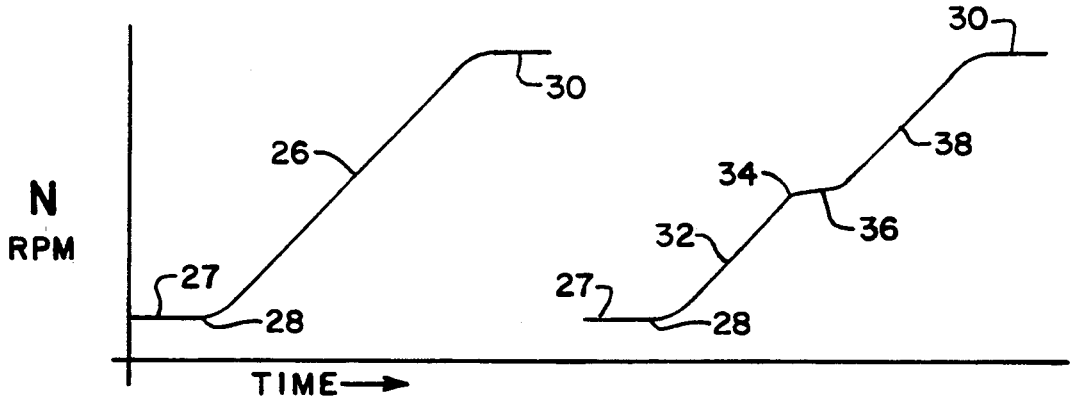
FIG. 2 is a plot of the gas generator speed during a ramp with and without a surge.

FIG. 2 illustrates on the left hand curve 26 a plot of the gas generator speed in revolutions per minute plotted against time. The initial low speed 27 is shown while at point 28 the speed starts to increase ramping up uniformly to reach the ultimate speed 30. The right hand curve 32 shows the same initial speed 27 and the initial acceleration rate increase 28 with the ramp up to the final speed 30. In this case however a compressor surge has occurred at point 34 resulting in a decreased rate of speed increase 36 immediately thereafter. On recovery from the surge the rate increases as shown by curve portion 38.

Figure 3:
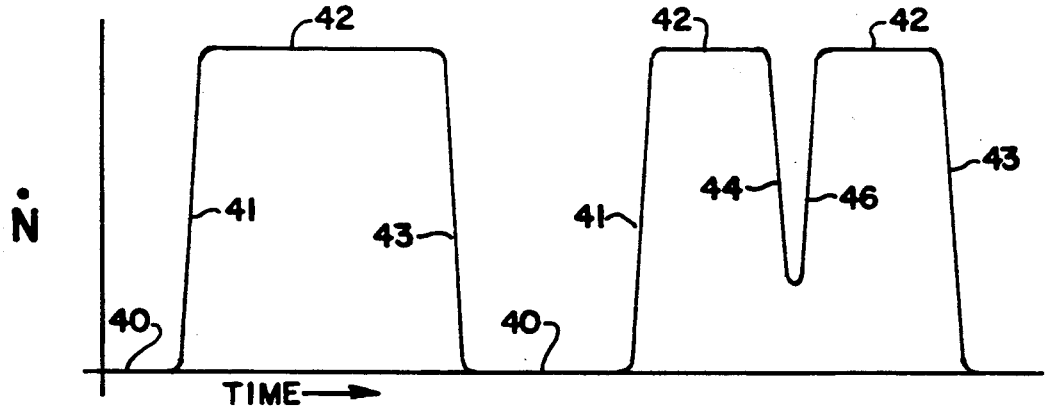
FIG. 3 is a plot of the gas generator acceleration during a ramp with and without a surge.

FIG. 3 is a plot of the derivative of the speed shown in FIG. 2 and is therefore a plot of the acceleration of the gas generator shaft. At the steady speed shown by curve 27 acceleration is zero as shown by curve portion 40. Drawing the ramp of curve 26 acceleration has increased to an amount shown by curve portion 42 while at the end of the ramp the acceleration decreases is shown by curve 43 down to zero.

The right hand portion of the FIG. 3 curve shows the same zero acceleration at 40 with a ramp 41 up to the level 42. At the surge condition starting at point 34 however there is a sudden decrease in the acceleration shown by curve 44 and an immediate recovery shown by curve 46 back to the original acceleration level 42. The close timing of dip 44 and recovery 46 differentiates this from a normal decreased acceleration 43 and increased acceleration 41.

Figure 4:
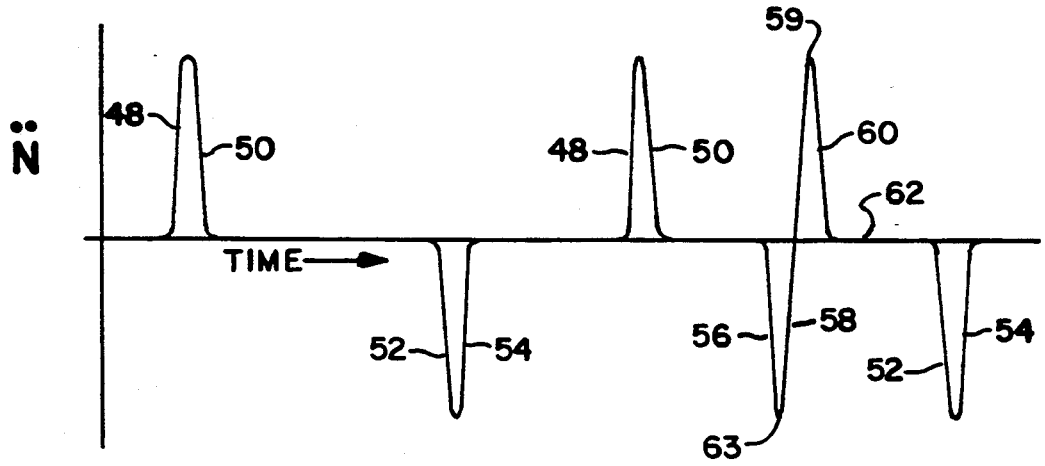
FIG. 4 is a plot of the double derivative of gas generator speed during a ramp with and without a surge.

FIG. 4 therefore is introduced as the double derivative of the speed (N) of the gas generator shaft which speed is shown on FIG. 2. This also is the derivative of the acceleration shown in FIG. 3. As the acceleration increases shown by line 41 the rate of change of acceleration shown by line 48 peaks, and immediately drops down as shown by line 50 as the acceleration changes to a uniform level at the curve 42. In a similar manner when the rate of acceleration decreases as shown by 43, the rate of change of acceleration 52 drops sharply returning to zero as shown by curve 54.

In the right hand portion of the FIG. 4 curve, corresponding to the power increase with a stall occurring, the beginning and end of the ramp is the same as normal power increase. At surge point 34 however when the acceleration drops as shown by curve 44 the rate of change of acceleration 56 dips sharply, while the recovery 46 results in a sharp increase in the rate of acceleration 58 to a high positive level 59. This is followed by a return 60 to the steady state zero condition 62. It is this sudden low peak 63 followed by a high peak 59 within an extremely short time it is indicative of the surge.

Since it is possible a certain maneuvering condition could cause this without a stall occurring, only a potential surge (rather than actual) condition is declared based on these two peaks. As described hereinafter the power shaft is also investigated and only if this also shows a potential stall condition is an actual stall condition declared.

Figure 5:
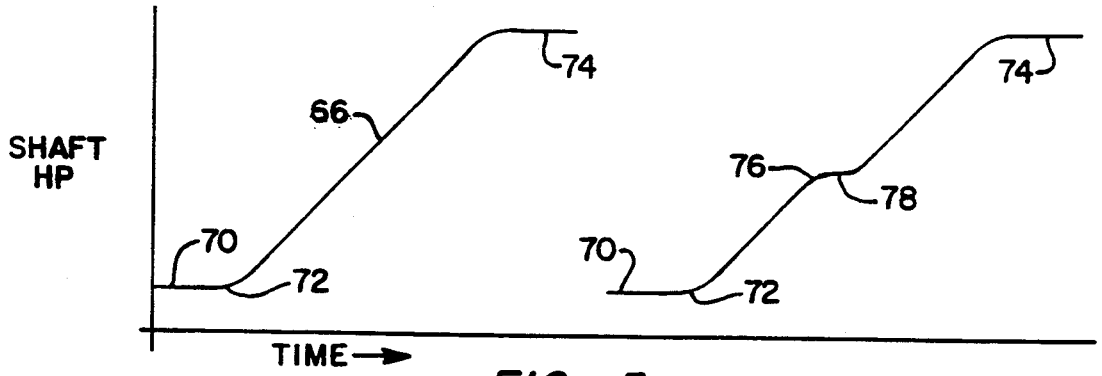
FIG. 5 is a plot of the shaft horsepower of the power shaft during a ramp with and without a surge.
Figure 6:
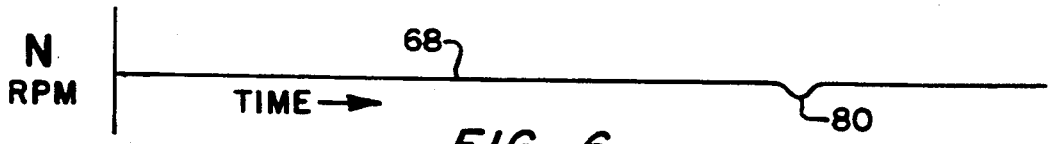
FIG. 6 is a plot of the speed of the power shaft during a ramp with and without a surge.

Referring to FIG. 5 the shaft horsepower increase is shown by curve 66 as plotted against time during a normal power increase. During this time, since the turbine is driving a helicopter rotor, the speed 68 as shown in FIG. 6 is maintained constant. The initial steady state low level of shaft horsepower 70 is shown and the initial increase to the ramp is shown by 72. Full horsepower is achieved as shown by the portion of the curve 74.

The right curve of FIG. 4 includes a surge. At the surge point 76 the shaft horsepower curve 78 shows a decrease in the rate of increase in shaft horsepower. As shown in FIG. 6 there is also a slight dip 80 in the speed of the power shaft.

The sudden change in rate of acceleration is known as a jerk affect, much in the way that one feels a jerk from the sudden increase in acceleration of a car. The jerk effect on the loss pressure during the surge is a negative effect resulting in both a loss of speed in the power shaft and also a loss of torque in the shaft as the load is being driven. The relative amounts of the speed decrease and the torque decrease is a function of the moment of inertia of the load being driven. With the helicopter as described here the moment of inertia is high, so there is a minor dip in speed. Accordingly the rate of change of torque is the factor used in the surge detection method.

Figure 7:
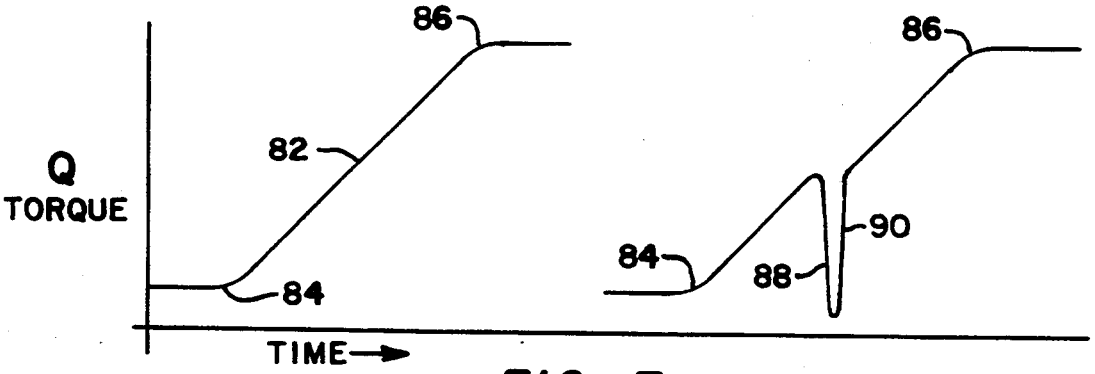
FIG. 7 is a plot of the torque of the power shaft during a ramp with and without a surge.

Therefore FIG. 7 shows the amount of torque passing through the power shaft, with the increase shown in curve 82 corresponding to the increase in horsepower shown in FIG. 5. With the torque being represented by Q and speed of the shaft by N, the shaft horsepower is a constant $\times Q \times N$. An initial increase in the rate of torque 84 is shown, as is the decrease in rate of torque 86 at the end of the ramp.

Referring to the right curve of FIG. 7, and corresponding to the surge caused sudden change of shaft horsepower 76 of FIG. 5 there is a rapid dip 88 in the torque. This is followed by a rapid increase 90 on the recovery from the surge.

Figure 8:
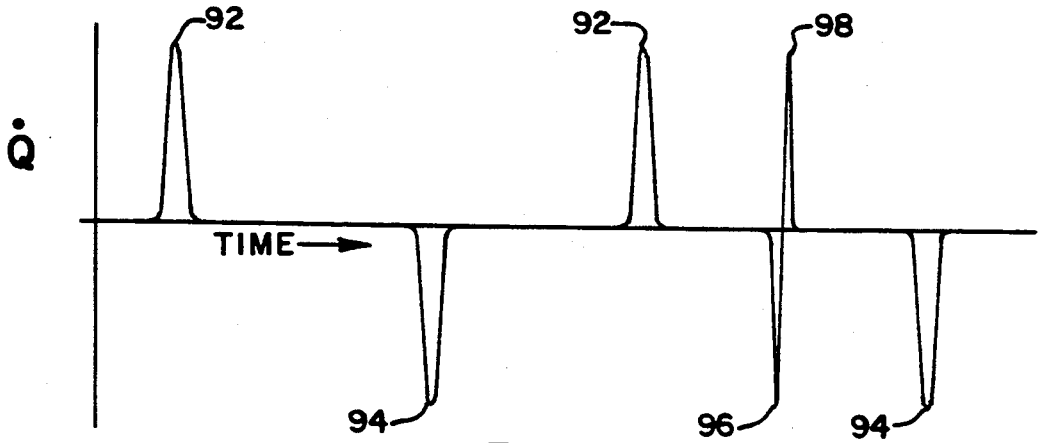
FIG. 8 is the derivative of the torque of the power shaft during a ramp with and without a surge.

FIG. 8 illustrates the derivative of torque (this being similar to the derivative of acceleration described before on the gas generator shaft). The peak in rate of change of torque is shown by point 92 initially with a corresponding decrease at the end of the ramp 82 shown by negative peak 94. When the surge condition occurs at point 76 the torque decreases as shown by curve 88, with a low peak 96 established followed by a high peak 98. It is the close timing and the breach of set magnitude limits of these two peaks that is used to declare a second potential stall condition.

Figure 9:
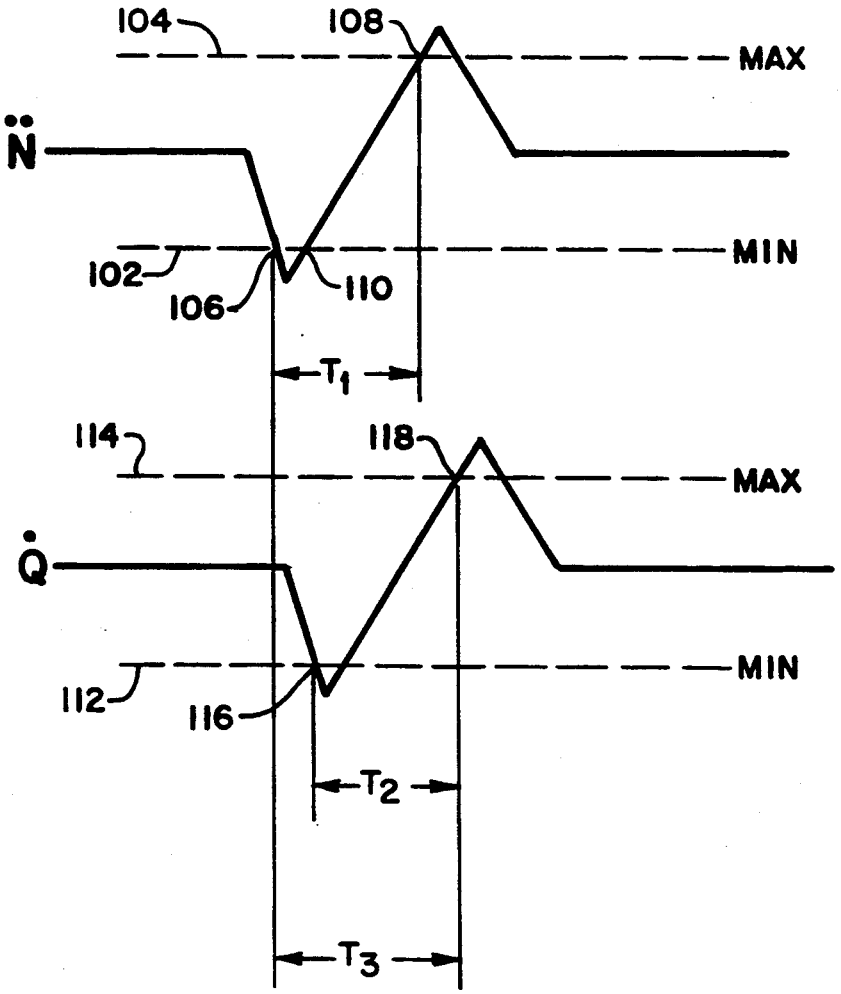
FIG. 9 is a plot of both the double derivative of gas generator speed and a torque of the power shaft along the same time plot.

On FIG. 9 there is shown with an expanded time scale both the double derivative of the gas generator shaft (N) as shown in FIG. 4, and the single derivative of torque (Q) as shown in FIG. 8. For the double derivative of the gas generator shaft a minimum limit 102 is established and a maximum limit 104. These values are established by test. When the double derivative of shaft speed breaches the lower limit 102 at point 106 a measurement of time for $T_1$ is started. When this double derivative of speed breaches a maximum limit 104 at 108 the time difference $T_1$ is sensed. This must be within a first predetermined time span such as 60 milliseconds. This is required to differentiate the surge condition from other maneuvering operations.

The breach is shown on this curve is when the derived value first exceeds the respective limits. It is also possible to use an alternate point such as when the derived value is returned to the minimum limit such as at point 110.

The other portion of this Figure shows the single derivative of torque compared to a minimum value 112 and maximum value 114. Time measurement for $T_2$ starts when the derivative of torque breaches limit 112 at point 116. The time difference $T_2$ being terminated when limit 114 is breached at point 118.

The total time $T_3$ is sensed from the initial breach of minimum limit 102 by the double derivative of the gas generator shaft to the maximum breach of limit 114 by the power shaft. This overall phenomenon must occur within this A range of 40 to 100 milliseconds is now deemed appropriate. Proper setting of this time limit as well as the minimum and maximum values must be based on tests for the particular engine and would be expected to vary with altitude.

As described above with respect to the power shaft both shaft speed and torque respond to the jerk effect of the surge. Where a low moment of interia load is connected to the power shaft, such as in a turbofan engine, the double derivative of shaft speed would be used for the power shaft as well as for the gas generator shaft. This of course would be used in lieu of the torque of the power shaft.

In response to the operation set forth above it is stated that a surge is declared. In response to such a declaration one would be expected to take corrective action, preferably by automatic controls to avoid repeated surging. This would be by reducing the fuel flow temporarily or by bleeding air. In common with other surge detection means a repeated surge despite reasonable corrective actions would indicate a major problem and the surge detection apparatus would be shut down.

Thus in comparison to the prior art methods of detecting surges there is provided this new method which has the advantage of using parameters commonly used by the control system for engine control functions.

I claim:

1. A method of sensing a compressor surge in a dual spool gas turbine engine having a gas generator shaft and a power turbine shaft comprising:

measuring the speed of said gas generator shaft;

determining the double derivative of said gas generator shaft speed;

establishing a first negative limit for the double derivative of said gas generator shaft speed;

establishing a second positive limit for the double derivative of said gas generator shaft speed;

comparing said determined double derivative of said gas generator shaft speed with said first and second limits;

sensing a speed breach of said first limit and of said second limit within a first predetermined time, and declaring a first potential surge condition in the presence of said speed breach;

measuring a power function of the power of said power turbine shaft;

determining the jerk effect on said power function of said power turbine shaft;

establishing a third negative limit for said jerk effect on said power turbine shaft;

establishing a fourth positive limit for said jerk effect on said power turbine shaft;

comparing said jerk effect with said third and fourth limits;

sensing a jerk effect breach of said third and fourth limits within a second predetermined time, and declaring a second potential surge condition in the presence of said jerk effect breach;

and declaring a surge condition only when said first potential surge condition is declared within a third predetermined time of said second declared potential surge condition.

2. The method of claim 1 wherein:

said jerk effect is the rate of change of acceleration in the speed of said power turbine shaft.

3. The method of claim 1 wherein:

said jerk effect is the rate of change of torque on said power turbine shaft.

4. A method of sensing a compressor surge in a dual spool gas turbine engine having a gas generator shaft and a power turbine shaft comprising:

measuring the speed of said gas generator shaft;

determining the double derivative of said gas generator shaft speed;

establishing a first negative limit for the double derivative of said gas generator shaft speed;

establishing a second positive limit for the double derivative of said gas generator shaft speed;

comparing said determined double derivative of said gas generator shaft speed with said first and second limits;

sensing a speed breach of said first limit and of said second limit within a first predetermined time, and declaring a first potential surge condition in the presence of said speed breach;

measuring the torque of said power turbine shaft;

determining the derivative of said power turbine shaft torque;

establishing a third negative limit for the derivative of said power turbine shaft torque;

establishing a fourth positive limit for the derivative of said power turbine shaft torque;

comparing said determined derivative of torque with said third and fourth limits;

sensing a torque breach of said third and fourth limits within a second predetermined time, and declaring a second potential surge condition in the presence of said torque breach;

and declaring a surge condition only when said first potential surge condition is declared within a third predetermined time of said second declared potential surge condition.

5. A method of sensing a compressor surge in a dual spool gas turbine engine having a gas generator shaft and a power turbine shaft comprising:

measuring the speed of said gas generator shaft;

determining the double derivative of said gas generator shaft speed;

establishing a first negative limit for the double derivative of said gas generator shaft speed;

establishing a second positive limit for the double derivative of said gas generator shaft speed;

comparing said determined double derivative of said gas generator shaft speed with said first and second limits;

sensing a speed breach of said first limit and of said second limit within a first predetermined time, and declaring a first potential surge condition in the presence of said speed breach;

measuring the speed of said power turbine shaft;

determining the double derivative of said power turbine shaft speed;

establishing a third negative limit for the double derivative of said power turbine shaft speed;

establishing a fourth positive limit for the double derivative of said power turbine shaft speed;

comparing said determined double derivative of said power turbine shaft speed with said third and fourth limits;

sensing a power turbine shaft speed breach of said third and fourth limits within a second predetermined time, and declaring a second potential surge condition in the presence of said power turbine shaft speed breach;

and declaring a surge condition only when said first potential surge condition is declared within a third predetermined time of said second declared potential surge condition.

6. A method as in claim 1 wherein:

said first and second predetermined time are not more than 60 milliseconds; and said third predetermined time is not more than 100 milliseconds.

7. A method as in claim 4 wherein:

said first and second predetermined time are not more than 60 milliseconds; and said third predetermined time is not more than 100 milliseconds.

8. A method as in claim 5 wherein:

said first and second predetermined time are not more than 60 milliseconds; and said third predetermined time is not more than 100 milliseconds.

* * * * *